US006109962A

United States Patent [19]

Chen-Shiang

[11] Patent Number: 6,109,962

[45] Date of Patent: Aug. 29, 2000

[54] ELECTRICAL CONNECTOR

[75] Inventor: Chiang Chen-Shiang, Taipei Hsien, Taiwan

[73] Assignee: Molex Incorporated, Lisle, Ill.

[21] Appl. No.: 09/257,747

[22] Filed: Feb. 25, 1999

[30] Foreign Application Priority Data

Mar. 20, 1998 [TW] Taiwan ..... 87204138

[51] Int. Cl.[7] ..... H01R 13/73; H01Q 7/00

[52] U.S. Cl. ..... 439/571; 343/870

[58] Field of Search ..... 439/571, 78, 916; 343/870, 906, 702, 803, 878

[56] References Cited

U.S. PATENT DOCUMENTS 5,030,107 7/1991 Moon ..... 439/62

5,716,230 2/1998 Marren et al. ..... 439/500

*Primary Examiner*—Lincoln Donovan
*Assistant Examiner*—Chandrika Prasad
*Attorney, Agent, or Firm*—Stephen Z. Weiss

[57] ABSTRACT

An electrical connector is provided for connecting an antenna to a printed circuit board. The connector includes a dielectric housing having a terminal-receiving cavity and is mountable on a surface of the printed circuit board. A terminal is received in the cavity and includes a contact portion and a terminating portion. The contact portion is disposed within the cavity and is structured for engaging a complementary contact portion of the antenna. The terminating portion projects from the cavity through the housing for termination to an appropriate circuit trace on the printed circuit board.

13 Claims, 5 Drawing Sheets

ELECTRICAL CONNECTOR

FIELD OF THE INVENTION

This invention generally relates to the art of electrical connectors and, particularly, to a connector for connecting an antenna to a printed circuit board.

BACKGROUND OF THE INVENTION

Antennas are widely used in wireless communication systems. An antenna often is electrically connected to a printed circuit board (PCB). The antenna typically is soldered directly to circuit traces on the PCB. Such soldering operations are labor-intensive and not cost effective. The soldering operations are cumbersome and require precise alignment between the antenna and the PCB. In addition, should an antenna become broken or the solder connection become damaged, the entire antenna/PCB is discarded and replaced.

The present invention is directed to solving these problems by providing a very simple and cost effective electrical connector for providing a stable connection between an antenna and a PCB by mechanical interengagement.

SUMMARY OF THE INVENTION

An object, therefore, of the invention is to provide a new and improved electrical connector for connecting an antenna to a printed circuit board.

In the exemplary embodiment of the invention, the connector includes a dielectric housing having a terminal-receiving cavity and mounting means for mounting the housing on a surface of the printed circuit board. A terminal is received in the cavity and includes a contact portion and a terminating portion. The contact portion is disposed within the cavity and is structured for engaging a complementary contact portion of the antenna. The terminating portion projects from the cavity through the housing for termination to an appropriate circuit trace on the printed circuit board.

As disclosed herein, a pair of the cavities and respective terminals are provided for receiving opposite contact ends of a loop-type antenna. The housing is a one-piece structure molded of plastic material, and the mounting means comprises at least one mounting post integrally molded with the housing for insertion into an appropriate mounting hole in the printed circuit board.

The terminal includes a mounting portion, with the terminating portion and contact portion being on opposite sides of the mounting portion. The terminating portion is formed by a plate for surface connection to the printed circuit board. The contact portion is formed by a plate having a slot for receiving a contact blade of the antenna.

The housing includes at least three apertures communicating each cavity with the exterior of the housing. One of the apertures allows the terminating portion of the terminal to project from the cavity. A second one of the apertures allows the complementary contact portion of the antenna to be inserted into the cavity. A third one of the apertures allows the antenna to project from the complementary contact portion through the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 1:
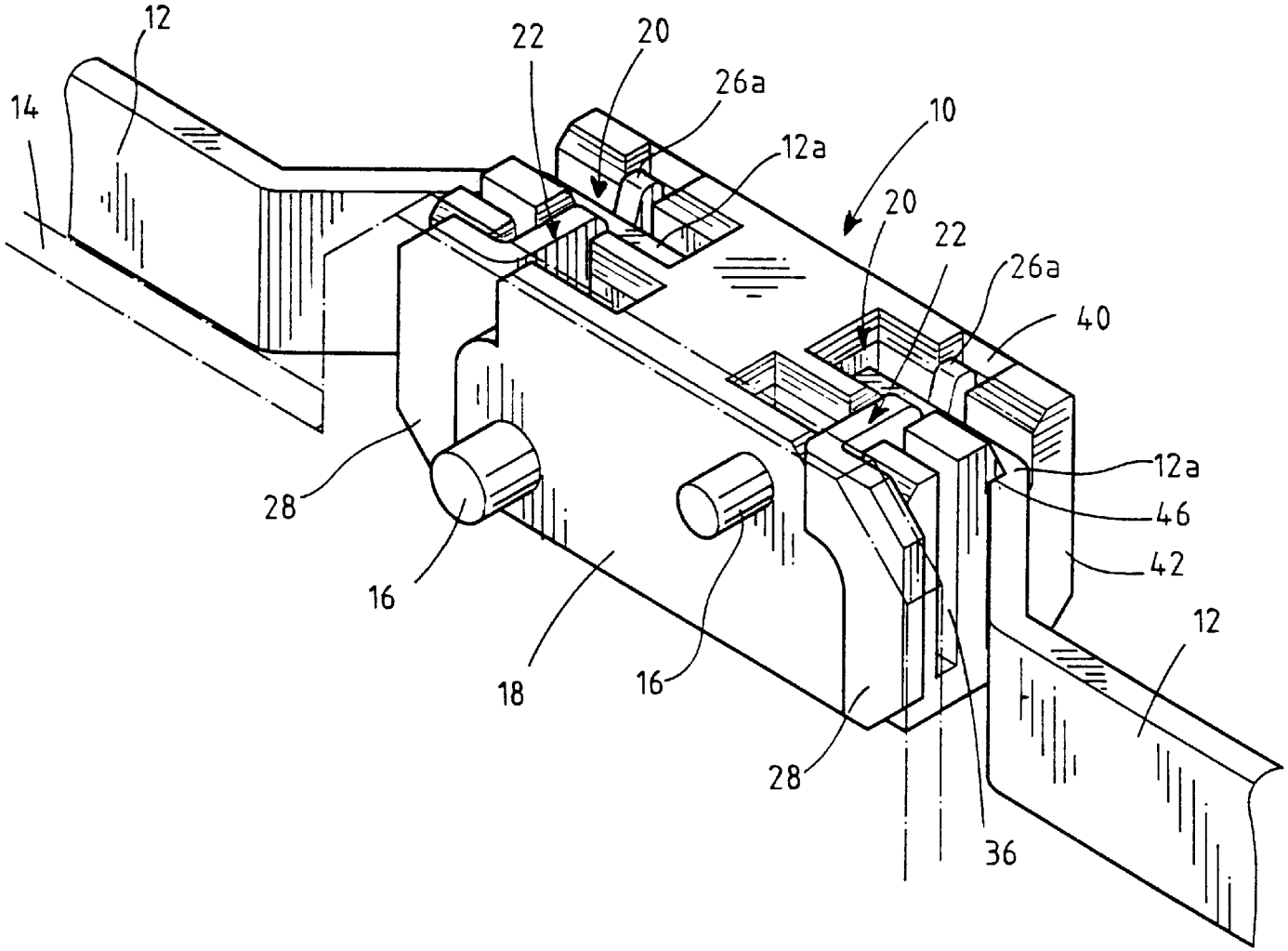
FIG. 1 is a perspective view of the electrical connector interconnected to opposite ends of an antenna and mounted on a printed circuit board shown in phantom.

Referring to the drawings in greater detail, and first to FIG. 1, the invention is embodied in an electrical connector, generally designated 10, for connecting an antenna 12 to a printed circuit board 14 shown in phantom.

Figure 2:
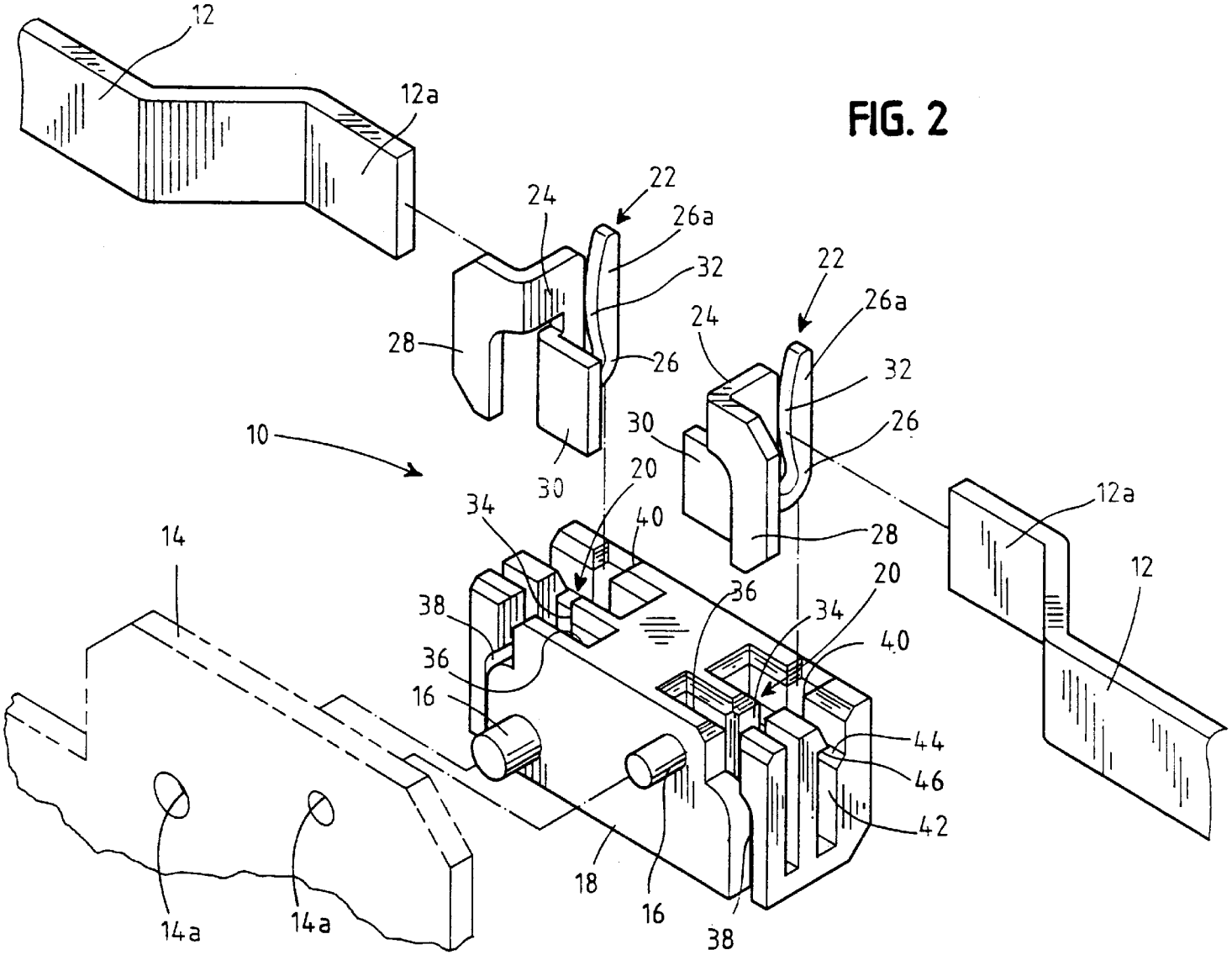
FIG. 2 is an exploded perspective view of the assembly of FIG. 1.
Figure 6:
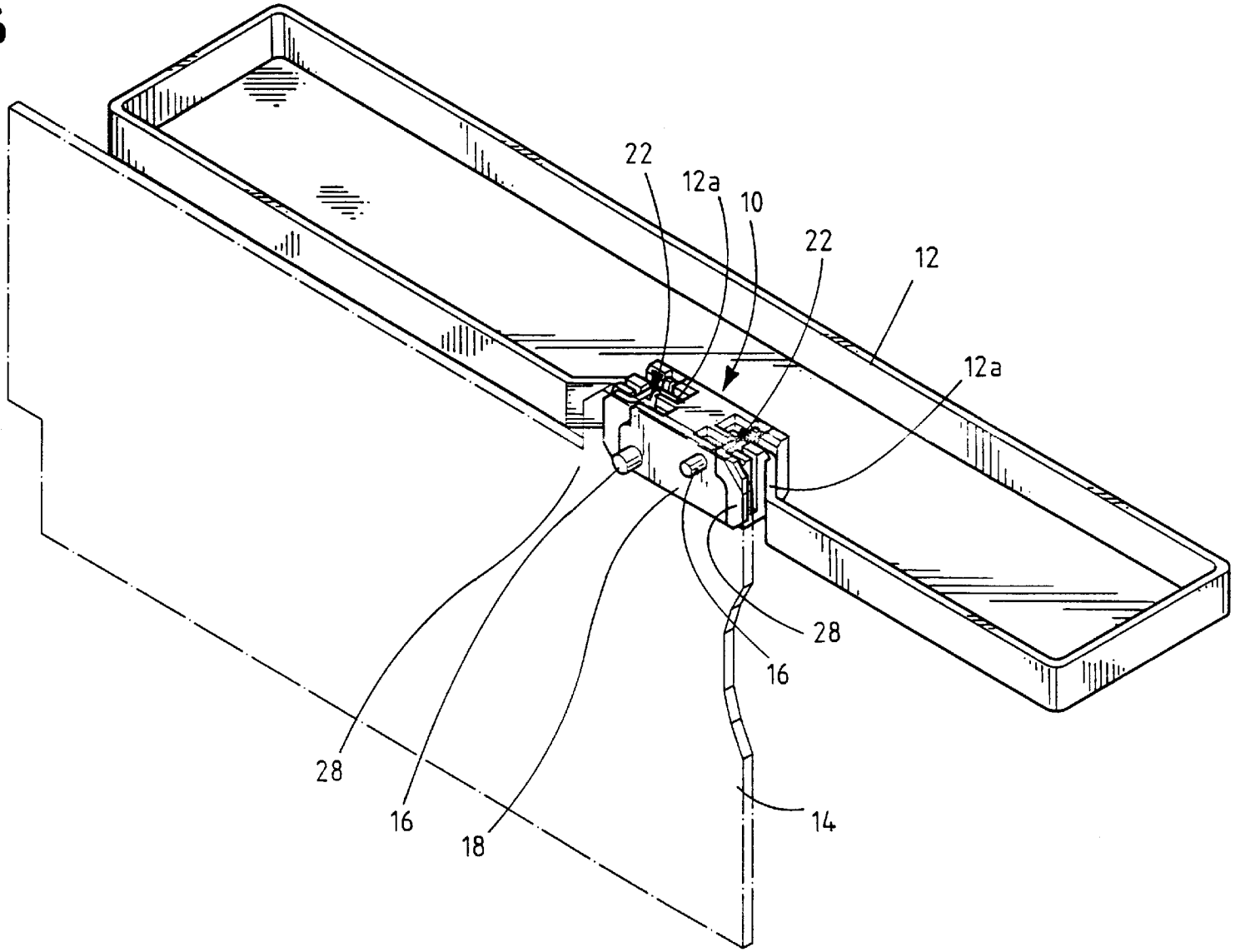
FIG. 6 is a perspective view of the connector and the full loop-type antenna, with the printed circuit board in phantom.

Referring to FIGS. 2 and 6 in conjunction with FIG. 1, antenna 12 is a loop-type antenna (see FIG. 6) having opposite ends defining complementary contact blades 12*a* of the antenna. Printed circuit board 14 has a pair of mounting holes 14*a* (see FIG. 2) for receiving a pair of mounting posts 16 projecting from a housing 18 of connector 10. Therefore, the housing and connector are surface mounted on the printed circuit board as seen in FIG. 6. Housing 18 is a one-piece structure unitarily molded of dielectric material such as plastic or the like. Mounting posts 16 are integrally molded with the housing. The housing includes a pair of terminal-receiving cavities, generally designated 20, for receiving a respective pair of terminals, generally designated 22.

More particularly, as best seen in FIG. 2, each terminal 22 is stamped and formed of sheet metal material. Each terminal includes a central body plate 24, with a contact plate 26, a terminating plate 28 and a mounting plate 30 all projecting outwardly from the body plate at different angles. Contact plate 26 defines a slot 32 for receiving a respective one of the contact blades 12*a* of antenna 12. The outer side of contact plate 26 forms a contact spring arm 26*a* which is biased against the contact blade of the antenna. Terminating plate 28 is provided for surface connection, as by soldering, to an appropriate circuit trace on printed circuit board 14. Mounting plate 30 is provided for mounting the respective terminal in a respective one of the terminal-receiving cavities 20 in housing 18.

Figure 4:
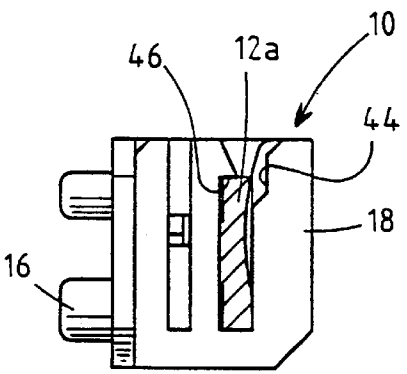
FIG. 4 is an end elevational view of the connector, with the antenna in phantom.
Figure 5:
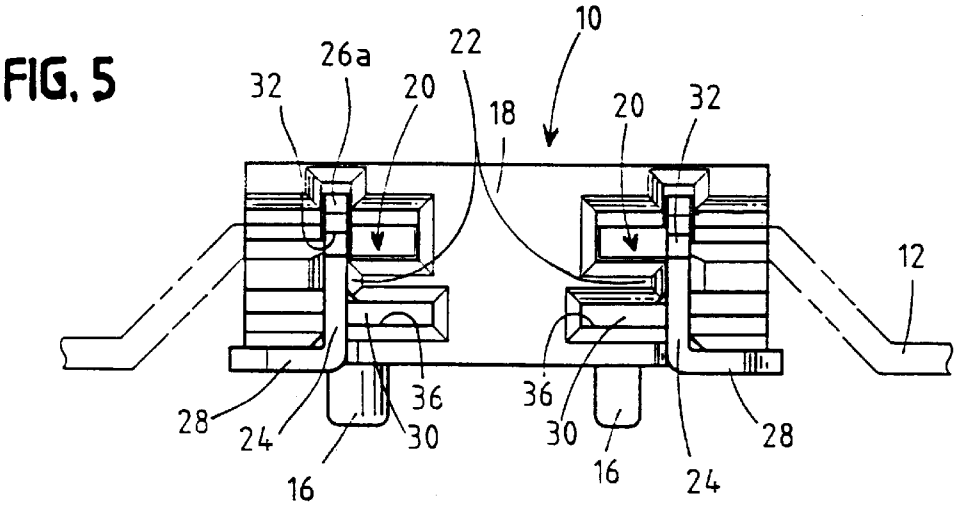
FIG. 5 is a top plan view of the connector, with the antenna in phantom.
Figure 3:
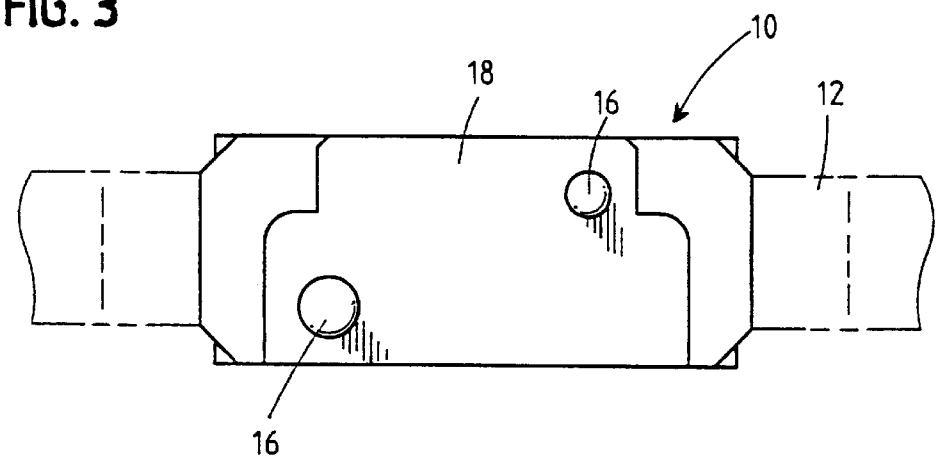
FIG. 3 is a bottom plan view of the connector, with the antenna in phantom.

As best seen in FIGS. 2, 4 and 5, each terminal-receiving cavity 20 includes a first slot 34 and a second slot 36 generally perpendicular to the first slot. Slot 34 receives body plate 24 of the respective terminal 22. Slot 36 receives mounting plate 30 of the terminal. In addition, housing 18 includes first, second and third apertures 38, 40 and 42, respectively, communicating with the interior of each cavity. Aperture 38 allows terminating plate 28 of the terminal to project from the cavity for termination to the circuit trace on the printed circuit board. Slot 40 allows one of the contact blades 12*a* of antenna 12 to be inserted downwardly into slot 32 in contact blade 26 of the respective terminal. Aperture 42 allows antenna 12 to project from the housing. As seen clearly in FIG. 2, aperture 42 has a camming surface 44 to guide contact blade 12*a* into the cavity and a latch hook 46 for locking the contact blade (and the antenna) to the connector housing, with the contact blade engaged with terminal 22 within slot 32 of contact plate 26. The contact blade of the terminal is shown best in its latched condition in FIG. 4.

Figure 7:
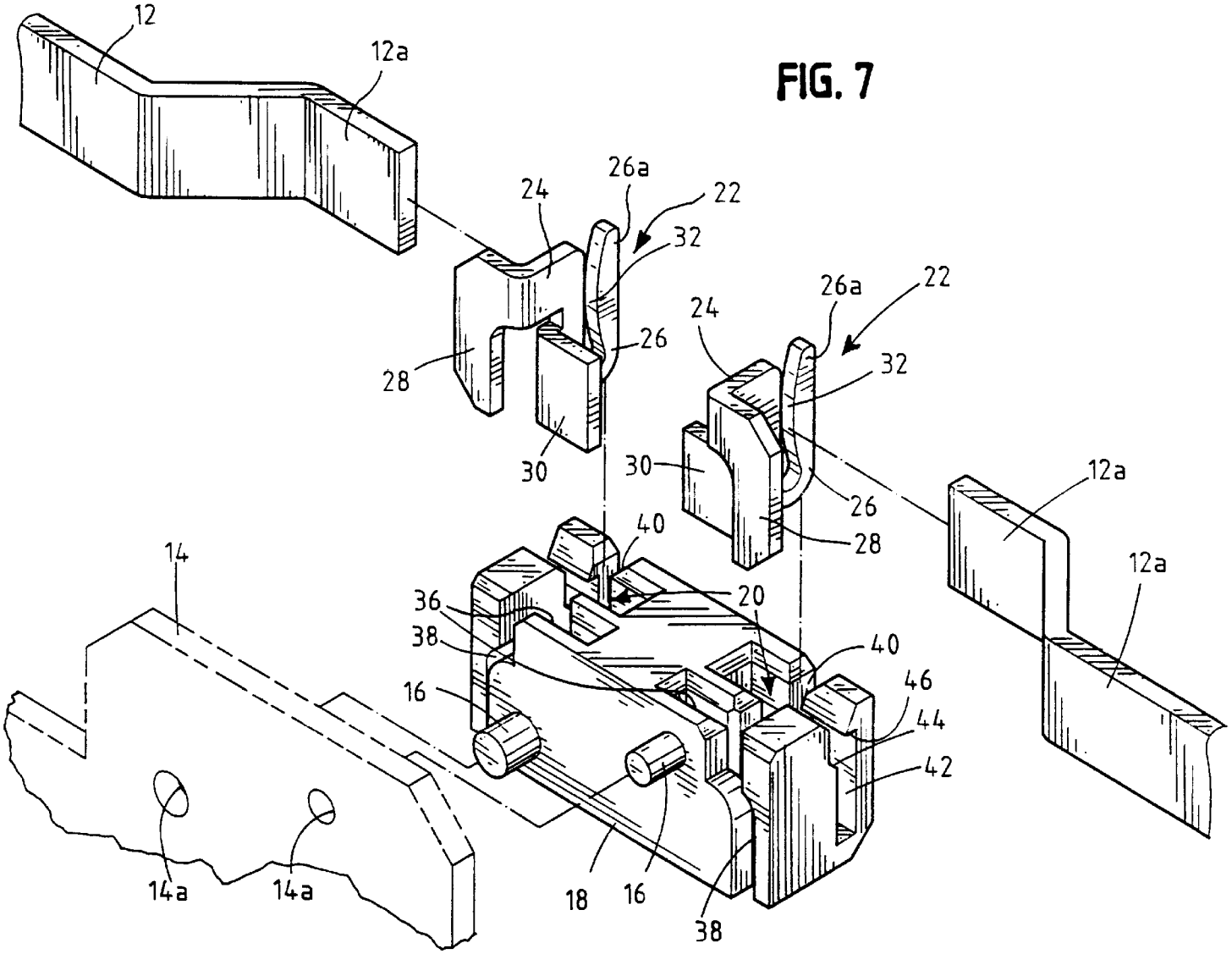
FIG. 7 is a perspective view of an alternate embodiment of the invention.

FIG. 7 shows an alternate embodiment of the connector wherein aperture 42, camming surface 44 and latch hook 46 are moved closer to the edge of the housing. This causes the biasing force of contact spring arm 26*a* of contact plate 26 to be larger, against the contact blade of the antenna.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for connecting an antenna to a printed circuit board, comprising:

a dielectric housing having a terminal-receiving cavity, mounting means for mounting the housing on a surface of the printed circuit board, and a latch hook extending into the cavity; and a terminal received in said cavity and including a contact plate and a terminating plate, the contact plate being disposed within the cavity and being structured for engaging a complementary contact portion of the antenna, the latch hook being structured for engaging the contact portion of the antenna to lock the antenna in the cavity, and the terminating plate projecting from the cavity through the housing for termination to an appropriate circuit trace on the printed circuit board.

2. The electrical connector of claim 1 wherein said mounting means comprises at least one mounting post for insertion into an appropriate mounting hole in the printed circuit board.

3. The electrical connector of claim 2 wherein said housing is a one-piece structure molded of plastic material, and the mounting post is integrally molded therewith.

4. The electrical connector of claim 1 wherein said terminating plate of the terminal comprises a portion for surface connection to the printed circuit board.

5. The electrical connector of claim 1 wherein said contact plate of the terminal comprises a portion having a slot for receiving a contact blade of the antenna.

6. The electrical connector of claim 1 wherein said terminal includes a mounting plate with said terminating plate and contact plate being on opposite sides of the mounting portion.

7. The electrical connector of claim 1 wherein said housing includes at least three apertures communicating said cavity with the exterior of the housing, one of the apertures allowing the terminating plate of the terminal to project from the cavity, a second one of the apertures allowing the complementary contact portion of the antenna to be inserted into the cavity, and a third one of the apertures allowing the antenna to project from the complementary contact portion through the housing.

8. The electrical connector of claim 1, including a pair of said cavities and respective terminals for receiving opposite contact ends of the antenna.

9. An electrical connector for connecting an antenna to a printed circuit board, comprising:

a dielectric housing having a terminal-receiving cavity, at least three apertures communicating the cavity with the exterior of the housing, mounting means for mounting the housing on a surface of the printed circuit board, and a latch hook extending into the cavity; and a terminal received in said cavity and including a contact plate having a slot for receiving a contact blade of the antenna and a terminating plate for surface connection to an appropriate circuit trace on the printed circuit board, the terminating plate projecting from the cavity through the first aperture in the housing, the second aperture allowing the contact blade of the antenna to be inserted into the slot in the contact plate of the terminal, the third aperture allowing the antenna to project from its contact blade through the housing, and the latch hook being structured for engaging the contact portion of the antenna to lock the antenna in the cavity.

10. The electrical connector of claim 9 wherein said mounting means comprises at least one mounting post for insertion into an appropriate mounting hole in the printed circuit board.

11. The electrical connector of claim 10 wherein said housing is a one-piece structure molded of plastic material, and the mounting post is integrally molded therewith.

12. The electrical connector of claim 9 wherein said terminal includes a mounting portion with said terminating plate and contact plate being on opposite sides of the mounting portion.

13. The electrical connector of claim 9, including a pair of said cavities and respective terminals for receiving opposite contact ends of the antenna.

* * * * *